US005669098A

United States Patent [19]

Tono

[11] Patent Number: 5,669,098

[45] Date of Patent: Sep. 23, 1997

[54] FLOOR CLEANING MACHINE WITH AN ADDITIONAL FLUID NOZZLE WITH CONNECTOR AND SUCTION BY-PASS

[76] Inventor: Gianni Tono, 11 Via Locchi, Padova, Italy, 35124

[21] Appl. No.: 496,670

[22] Filed: Jun. 29, 1995

[30] Foreign Application Priority Data

| | | | |
|---|---|---|---|
| Jul. 15, 1994 | [IT] | Italy | PD94A0134 |
| Oct. 5, 1994 | [IT] | Italy | PD94A0169 |
| Oct. 13, 1994 | [IT] | Italy | PD94A0175 |
| Oct. 25, 1994 | [IT] | Italy | PD94A0186 |

[51] Int. Cl.[6] ..... A47L 11/30

[52] U.S. Cl. ..... 15/321; 15/337

[58] Field of Search ..... 15/321, 322, 328, 15/331, 334, 337

[56] References Cited

U.S. PATENT DOCUMENTS

| | | | |
|---|---|---|---|
| 4,167,798 | 9/1979 | Klugl et al. | 15/334 |
| 4,563,790 | 1/1986 | Clark | 15/337 |
| 4,809,397 | 3/1989 | Jacobs et al. | 15/334 |
| 4,893,375 | 1/1990 | Girman et al. | 15/334 |
| 5,400,462 | 3/1995 | Amoretti | 15/322 |
| 5,493,752 | 2/1996 | Crouser et al. | 15/334 |

FOREIGN PATENT DOCUMENTS

| | | | |
|---|---|---|---|
| 537894 | 4/1956 | Italy | 15/334 |

*Primary Examiner*—David Scherbel
*Assistant Examiner*—Terrence Till
*Attorney, Agent, or Firm*—Dowell & Dowell

[57] ABSTRACT

A floor cleaning machine having an additional nozzle which is slidably insertable with respect to the machine's dirty liquid suction duct to thereby by-pass the dirty liquid suction duct to provide suction to a suction conduit associated with the additional nozzle and to simultaneously provide a source of cleansing liquid through a valve to the additional nozzle.

4 Claims, 6 Drawing Sheets

FLOOR CLEANING MACHINE WITH AN ADDITIONAL FLUID NOZZLE WITH CONNECTOR AND SUCTION BY-PASS

BACKGROUND OF THE INVENTION

1. Field of the Invention

The present invention concerns floor-cleaning machines.

2. History of the Related Art

At present there are several kinds of machines used for the removal of dirt from floors and for washing and drying floors. There are also machines for collecting solid dirt, washing and drying floors which, to clean also the areas which are most difficult to reach (under low pieces of furniture, under shelves, under radiators, wall recesses in correspondence with the floor, corners), are provided with nozzles installed at the end of a pipe. Two ducts, one conveying water and detergent to the nozzle and the other allowing the machine to suck dirty water, are coupled with the pipe, through which it is possible to extend the nozzle to the desired points.

In machines with additional nozzle water connection and suction ducts which are connected to the machine separately, it is necessary to manually deviate the flows from suction nozzles and from sprayers of the machine to the suction nozzles and sprayers of the additional nozzle, and vice versa.

Such couplings and deviations involve a waste of time; further, it is possible to fail to connect or to misconnect a duct or to fail to deviate the flows, which results in bad washing which requires the user to repeat the operation.

SUMMARY OF THE INVENTION

In order to eliminate the above-mentioned drawbacks, a new kind of machine with an additional nozzle has been designed and implemented, in which the connection between the machine and the additional nozzle and the relevant flow deviations are carried out with a single, simple operation.

The new machine is provided with an additional nozzle having the clean water and detergent conveying duct (here below called cleansing liquid conveying duct) and the dirty water and solid dirt suction duct (here below called suction duct) grouped and inserted in a single manifold which is installed on the floor-cleaning machine.

The floor-cleaning machine is provided with a small door giving access to a nozzle communicating with the conveyance and suction ducts.

On the insertion of the additional or secondary nozzle or by-pass manifold, a device inserted in the nozzle automatically deviates the flows deriving from the suction and conveyance of the cleansing liquid from the brush of the floor-cleaning machine to the additional nozzle. By inserting the manifold of the additional nozzle, a device—connected to the nozzle—automatically deviates the two flows from the cleaning brush to the additional nozzle. Similarly, on the extraction of the manifold from the nozzle said device carries the flows back to their normal course.

The connecting manifold and the deviating mechanism are designed so that the insertion and extraction of the manifold into and from the primary nozzle are guided by protrusions or cone-shaped elements, and the flow deviation takes place properly only if the manifold has been correctly inserted or is being extracted.

This way, to use the additional nozzle it is sufficient to insert the manifold thereof in the primary nozzle of the floor-cleaning machine; when the user wants to employ the main brush again, he only needs to extract the manifold from the primary nozzle.

The floor-cleaning machine with additional nozzle provided with the above-described connection system makes it possible to install the additional nozzle ducts and to deviate the conveyance and suction flows by means of a single operation; it also makes it possible to disconnect the additional nozzle and to restore the previous flows with a single disconnecting operation.

The floor-cleaning machine is provided with dirty liquid suction ducts placed at the front and at the rear of the cleaning brush and with the additional nozzle having, on the outer part of its structure, a coupling closed with a sealing cover and communicating with the dirty liquid suction duct and with the cleansing liquid conveying duct of the machine. A special valve system consisting of balls and springs prevents the cleansing liquid from being sucked into the dirty liquid duct.

The cleansing liquid conveying duct of the additional nozzle is placed either inside or beside the dirty water suction duct and the ends of the two ducts are joined in a single, conic manifold which, when inserted in the primary nozzle of the floor-cleaning machine, obstructs the liquid suction ducts from the front and the rear of the cleaning brush, thus connecting the suction pump with the suction duct of the additional nozzle. The conic manifold moves the balls inside the nozzle, thus interrupting the flow of the cleansing liquid towards the sprayers of the machine and deviating it to the conveying duct of the additional nozzle.

With some machines with two suction nozzles a suction duct is also provided before the brush, with respect to the machines motion, which doesn't provide perfect cleaning, which means that to obtain a degree of cleanliness on particularly dirty areas it is necessary to pass the floor-cleaning machine more than once over the area.

In order to eliminate the above-mentioned drawbacks, a floor-cleaning machine has been designed and implemented, which sucks the dirt and the cleansing liquid either from the rear or the front nozzle, according to the machine forward or backward motion.

In the new machine the two front and rear drying nozzles, "squeegee type", are mounted on a support which is partially constrained to the rest of the machine structure; the nozzle support is rigidly guided by the structure of the floor-cleaning machine in all directions, but it can also carry out a short relative forward or backward movement with respect to the machine.

The suction and drying nozzles, which are communicating, are connected to the same aspirator and each is provided with an opening positioned on the side which is diametrically opposite to the brush. The front nozzle is provided, in its front part, with a slot or hole, here below called control hole, and the brush is behind it, while the rear nozzle is provided with a hole in its rear part and the brush is before it.

The machine is equipped with two elastic sealing surfaces, for examples two seals or two rubber panels, positioned in correspondence with the control holes of the nozzle, at a distance which is than the maximum relative shift possible between the machine structure and the nozzle support.

During the use of the floor-cleaning machine as decribed above, the nozzle support moves through friction, with respect to the structure, in the direction opposite to the motion of the machine, until it comes into contact with the structure itself, that is, until the control hole of the nozzle positioned behind the brush, with respect to the motion of the machine, comes into contact with the elastic sealing surface and closes. On the other hand, the nozzle positioned before the brush with respect to the motion of the machine moves from the relevant elastic sealing surface, thus allowing the passage of air from the outside into the suction nozzle.

In this manner the aspirator to which the two nozzles are connected sucks the cleansing liquid only from the nozzle with closed control hole (behind the brush with respect to the motion of the machine), while it sucks air from the nozzle with open control hole.

When the motion of the machine is reversed, the nozzle support closes the control hole which was previously open and opens the control hole which was previously closed through friction. This way the cleansing liquid is always sucked from the floor only by the nozzle which is behind the brush with respect to the advancing motion of the floor-cleaning machine.

The suction nozzles are provided, in their lower part, with flexible plastic edges which scrape the floor and retained the liquid so that it can be sucked. In order to properly suck the accumulated liquid from the lower edges of the suction nozzles, the smallest machines must proceed rather slowly. To suck the liquid and the dirt, the nozzles and the ducts are large and therefore it is necessary to use more powerful and consequently oversized aspirators.

Further, if some liquid remains on the floor after the passage of the floor-cleaning machine, and it isn't possible to suck it with the machine, it is necessary to complete the job with cloths, scrubbing brushes or other means.

On the other hand, if the lower edges of the nozzles adhere to the floor too much, the liquid and the dirt cannot pass from the compartment in which the brush rotates to the inside of the nozzles.

There are machines provided with selective nozzle edges, which allow dirt to pass from the brush compartment to the inside of the nozzles themselves, without flowing out of the rear edge of the rear brush, with respect to the motion of the machine, and are also provided with additional suction ducts directly in the area along the edges of each nozzle, on which dirt and liquid accumulate.

The lower edges of the nozzles are made of soft plastic material, their height is such that during movement they bend their lower end in the opposite direction with respect to the motion of the machine, their lower corner is not curved and their shape changes according to the position they take.

The nozzle edges positioned farthest from the brush, that is, the two extreme edges of the floor-cleaning machine, have a rectangular horizontal section; the nozzle edges positioned nearest to the brush have their vertical surface facing the brush, while the surface facing the brush compartment is provided with deep vertical protrusions spaced from one another, squared or curved or having a different shape and the surface facing the inside of the nozzle is smooth.

In order to solve the above-mentioned problems, an additional suction duct is positioned inside each nozzle and its mouth is positioned near the floor, in correspondence with the area where dirty water accumulates, that is, with the edge of the nozzle which is farthest from the brush and without protrusions.

In the following description, the words "front" and "rear", "forward" and "backward", "before" and "behind" are to be understood as referred to the motion of the floor-cleaning machine.

Therefore, a machine is described, which is provided with two suction systems, each one of which can be operated alone or in combination with the other. One of the two systems consists of the well-known air suction system, which draws in water and dirt, while the other one consists of the new additional system which pumps water directly from the floor through ancillary ducts.

During the use of the machine the lower ends of the nozzle bend backwards.

The front edge of the front nozzle and the rear edge of the rear nozzle, which have smooth surfaces, adhere to the floor avoiding any outflow of liquid; the rear edge of the front nozzle adheres to the floor with its smooth front surface also preventing any outflow of liquid, too; the front edge of the rear nozzle rests on the floor with the protrusions of its front surface, thus allowing the brush to push liquid and the dirt inside the rear nozzle.

The dirt which enters the rear nozzle and accumulates near the rear edge of the nozzle is mostly sucked by the additional duct, while the inside suction of the nozzle removes the remaining liquid and dries part of the floor.

By reversing the motion of the machine, the lower edges of the nozzles bend in the opposite direction, so that the rear edge of the front nozzle adheres to the floor with its smooth surface and prevents the liquid from spreading forward, while the front edge of the rear nozzle adheres to the floor with the surface provided with protrusions and makes it possible to push the liquid inside the rear nozzle.

The floor-cleaning machine is provided, inside each nozzle, with one or more additional pumping ducts, the ends of which are positioned in correspondence with the edge which is farthest from the brush and in correspondence with the floor, in such a way as to lift the accumulated liquid and dirt.

The tanks of floor-cleaning machines containing cleansing liquid which are used at present are fixed and it is necessary to pour the cleansing liquid into them with all the problems involved in the lifting of the container and in pouring the liquid into a tank without spilling it.

Some machines are provided with a removable tank, but the taking of the cleansing liquid by the machine itself is carried out by means of a drawing duct placed on the bottom of the tank and the duct must be lifted and put back every time the tank is removed; the same happens for the dirty liquid collecting tank, which can be removed, but every time requires the re-positioning of the dirty liquid draining duct.

The filling and emptying of the dirt tank, the positioning of the ducts and so on make the use of a floor-cleaning machine more difficult and increase the risk of mispositioning of the ducts, which would result in the non-suction of the cleansing liquid or in the discharge of the dirty liquid out of the collecting tank.

The tank of the new machine can be removed and is provided with a valve, preferably on its bottom, which is normally closed and can be opened by means of a suitable manifold.

The tank is housed in a special compartment, on the bottom of which is the manifold, which is connected with the system that conveys the cleansing liquid onto the brush.

On the introduction of the tank in its compartment the manifold opens the tank valve and the liquid which is inside the tank flows through the manifold into the washing circuit of the floor-cleaning machine.

Similarly, on the extraction of the tank from its compartment the manifold releases the valve of the tank, which promptly closes, thus preventing the outflow of any liquid still present in the tank.

Either the tank and the tank compartment and likewise the connecting manifold and the tank valve, are designed so that the introduction and the extraction of the tank into and from the compartment and of the manifold into and from the valve are guided by protrusions or cone-shaped elements so that the opening of the valve takes place only when the tank has been correctly inserted in its compartment or so that the valve closes when one starts extracting the tank.

This way to fill, empty or just remove the tank, be it full or empty, it is sufficient to introduce it into or extract it from its compartment in the floor-cleaning machine.

The floor-cleaning machine with the removable tank provided with the above-mentioned connection system makes it possible to fill the cleansing liquid tank separately, to connect the liquid conveying system of the machine with the tank by simply introducing the tank in its compartment, and to disconnect the liquid conveying system of the machine from the tank by simply extracting the tank from its compartment, without causing any outflow of the cleansing liquid.

The same concept and the same connection system can be applied to the tank which collects the dirty cleansing liquid and dirt in general; in this case it is necessary to provide the manifold positioned on the machine with a second valve, in order to prevent the dirty liquid from being pumped out of the collecting tank.

In the case of a single tank having an elastic partition plate, two separate valves communicating with the two sections of the tank will be placed on the tank bottom and two separate manifolds, each one connecting one of the tank valves with the relevant conveyance or collection system, will be placed on the bottom of the tank compartment.

BRIEF DESCRIPTION OF THE DRAWINGS

FIG. 8 is a partial cross-sectional side view of another embodiment of the present invention showing a removable cleansing solution tank.

DESCRIPTION OF THE PREFERRED EMBODIMENT

Figure 1:
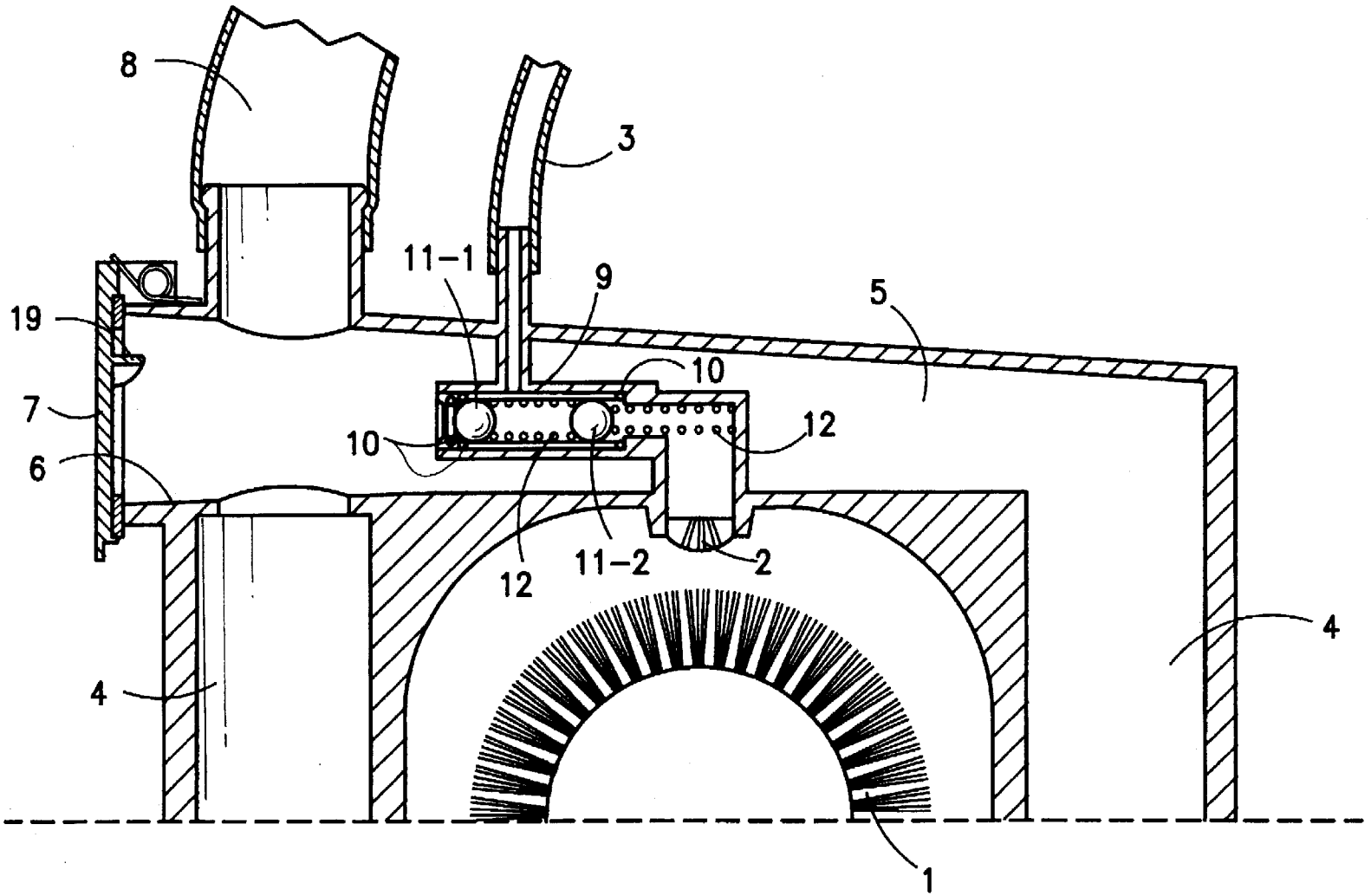
FIG. 1 is a partial schematic, side cross-sectional view of the floor-cleaning machine of the present invention shown without an additional fluid nozzle.
Figure 1A:
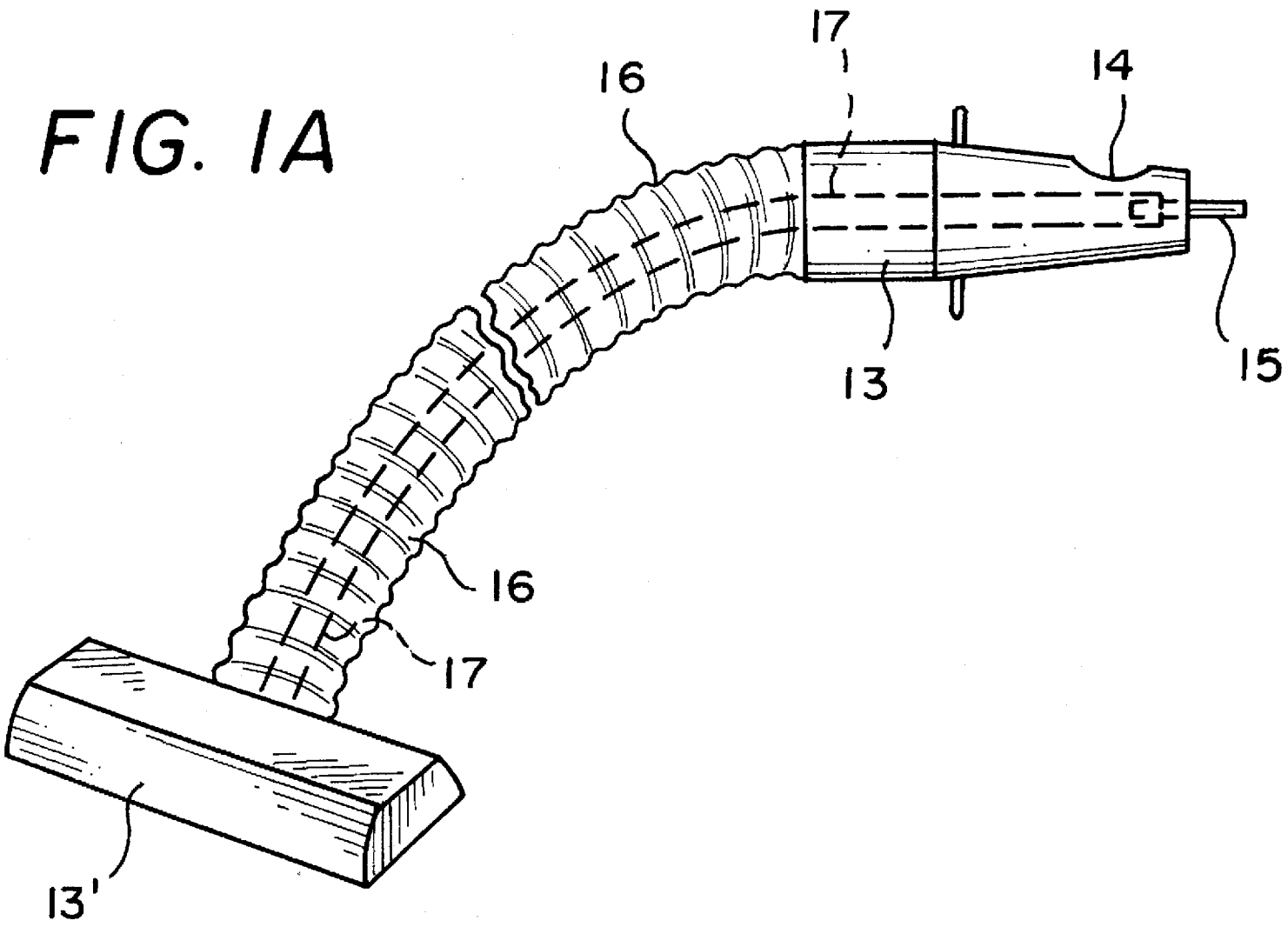
FIG. 1A is an illustrational view of the additional nozzle assembly of the present invention.
Figure 2:
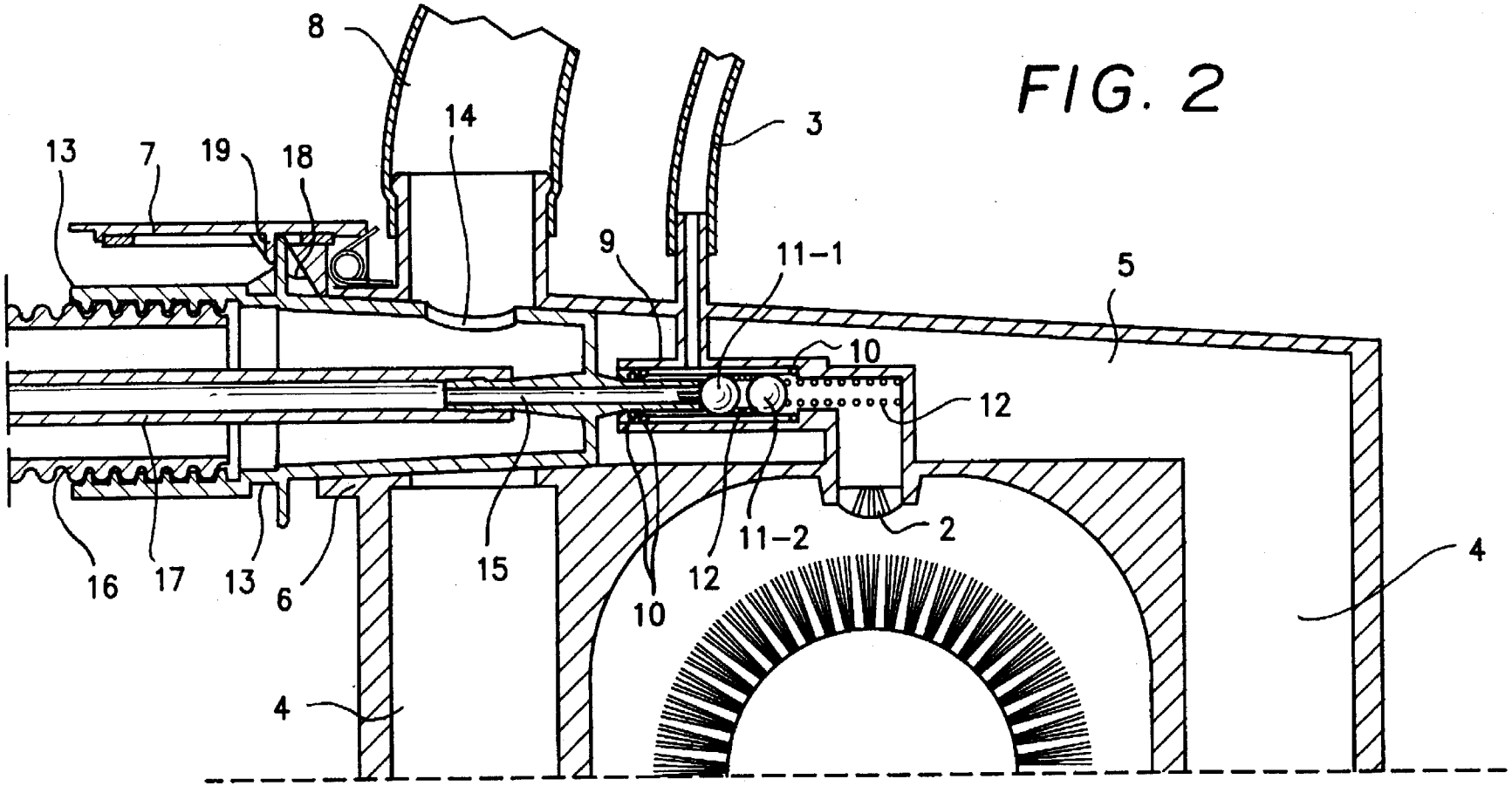
FIG. 2 is a view similar to FIG. 1 showing the additional fluid nozzle being inserted into the floor-cleaning machine.

FIG. 1 shows a partial, schematic, upper side view of the floor-cleaning machine without manifold, while FIG. 2 shows a partial, schematic side view of the same parts with the manifold.

The cleaning brush (1) receives the cleansing liquid through a sprayer (2) positioned over it, which is connected to the cleansing liquid tank and to the relevant pump (not shown in the drawing) by means of a conveying or inlet duct (3).

At the front and at the rear of the cleaning brush (1) there are two ducts (4) for the suction of the dirty cleansing liquid; the two suction ducts (4) are communicating through a piece of horizontal connecting duct (5) passing above the cleaning brush (1) and around the liquid conveying duct (3).

The horizontal connecting duct (5) ends, at the front of the floor-cleaning machine, with a coupling (6) closed by means of a hinged cover (7). The coupling (6), the front suction duct (4) and the duct (8) connecting the suction ducts (4, 5) to the relevant suction pump (not shown in the drawing) are positioned at the front of the machine, very near one another, and are quite easy to reach.

In the area where it is surrounded by the horizontal suction duct (5), the cleansing liquid conveying duct (3) has a horizontal supply valve section (9) which is open towards the front, that is, towards the coupling (6), having seals (10), two balls (11-1, 11-2) and springs (12) inside.

The balls (11-1, 11-2) and the springs (12) are placed in alternate positions, so that in normal conditions one of the balls (11-1) is pushed against the seal (10) positioned on the opening facing the front part of the conveying duct section (9), thus closing it, while the second ball (11-2) is kept in an intermediate position. This way the cleansing liquid flows around the second ball (11-2), until reaching the sprayer (2) placed over the cleaning brush (1).

The connecting or by-pass manifold (13) of the additional nozzle 13' (FIG. 2) is cone-shaped and has a hole (14) on its upper lateral surface, while a short piece of pipe (15), rigid and coaxial to the manifold, is placed at the end of the manifold.

The suction pipe (16) of the additional nozzle is connected to the manifold (13); inside the suction pipe (16) there is a cleansing liquid conveying pipe or cleansing duct (17), connected with the rigid coaxial pipe (15) of the manifold (13).

On the opening of the cover (7) of the coupling (6) and on the insertion of the manifold (13) in the coupling (6), the manifold occludes the suction ducts (4, 5), making its hole (14) match the suction duct of the suction pump (8).

At the same time, the short piece of rigid pipe (15) coaxial to the manifold (13) slides into the short horizontal piece of the conveying pipe (9), pushing the first ball (11-1) and the second ball (11-2) by means of the springs (12).

In this situation the second ball (11-2) is pushed against the seal (10), thus preventing the cleansing liquid from flowing towards the sprayer (2); at the same time the first ball (11-1) goes back into the piece of pipe (9), allowing the cleansing liquid to flow through the short piece of rigid pipe (15) and through the inner conveying pipe (17), until reaching the additional nozzle.

The suction pump sucks the dirty liquid through the connection duct (8) and through the manifold (13) and its suction pipe or conduit (16).

By extracting the manifold (13) from the coupling (6) and letting its cover (7) close, it is possible to restore the initial conditions.

Both the manifold (13) and the coupling (6) are provided with protrusions and grooves which allow their mutual connection in a single specific position. Further, two special teeth (18, 19) positioned on the manifold (13) and on the cover (7) of the coupling (6) prevent the manifold (13) from accidentally coming out of the coupling (6).

Figure 3:
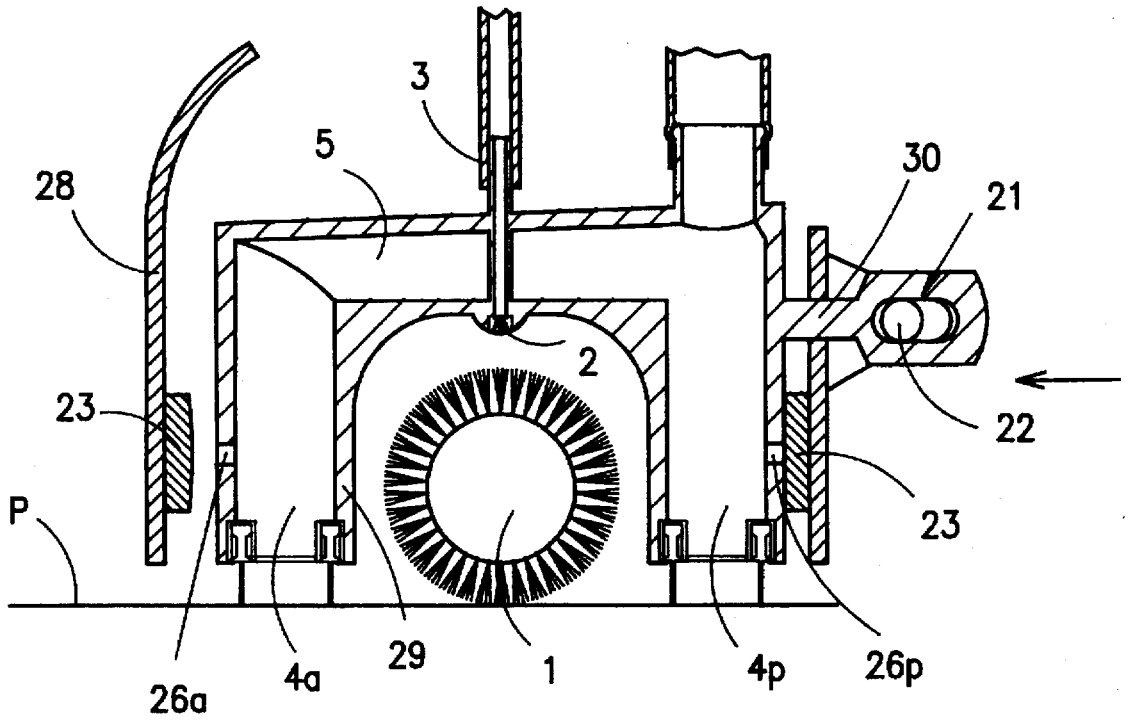
FIG. 3 is a partial, schematic side cross-sectional view showing moveable members for controlling the suction to the front or rear ducts of the machine.

FIG. 3 shows a partial schematic side view of the floor-cleaning machine.

The cleaning brush (1) receives the cleansing liquid through a sprayer (2) positioned over it.

At the front and at the rear of the cleaning brush (1) there are two ducts (4*a*, 4*p*) for the suction of the dirty cleansing liquid; the two suction ducts (4*a*, 4*p*) are communicating by means of a section of horizontal duct (5) passing above the cleaning brush (1) and around the cleansing liquid conveying duct (3).

Each suction nozzle (4*a*, 4*p*) is provided with a control hole (26*a*, 26*p*) along the suction duct, at a given distance from the floor (P); these control holes are positioned on the duct diametrically opposite to the brush (1).

The suction nozzles (4*a*, 4*p*) aren't rigidly fixed to the rest of the structure (28) of the floor-cleaning machine, but are mounted on a support (29) which can move with respect to the structure (28); in particular, the structure (28) guides the support (29) in all its movements, ensuring also a short relative forward or backward movement. For this purpose the support (29) is provided with an arm (30) ending with a slot (21) in which a pin (22) slides, which is integral with the structure (28) of the floor-cleaning machine.

On the structure (28) of the machine there are two elastic sealing surfaces (23), for example two rubber panels, positioned in front of the control holes (26*a*, 26*p*), at such a distance that when the support (29) is in one of the two extreme positions, one of the control holes (26*a*, 26*p*) of the suction nozzles (4*a*, 4*p*) is opened and the other is closed by the elastic surface (23).

FIG. 3 represents the situation in which the machine is pushed: the support (29) remains backward through friction, that is, it remains in the direction opposite to the motion of the machine and the hole (26*p*) of the rear nozzle (4*p*) is pressed against the corresponding elastic surface (23), while the front suction nozzle (4*a*) remains spaced from the relevant elastic surface (23), thus leaving the hole (26*a*) open; consequently, the suction is carried out by the rear nozzle (4*p*).

Figure 4:
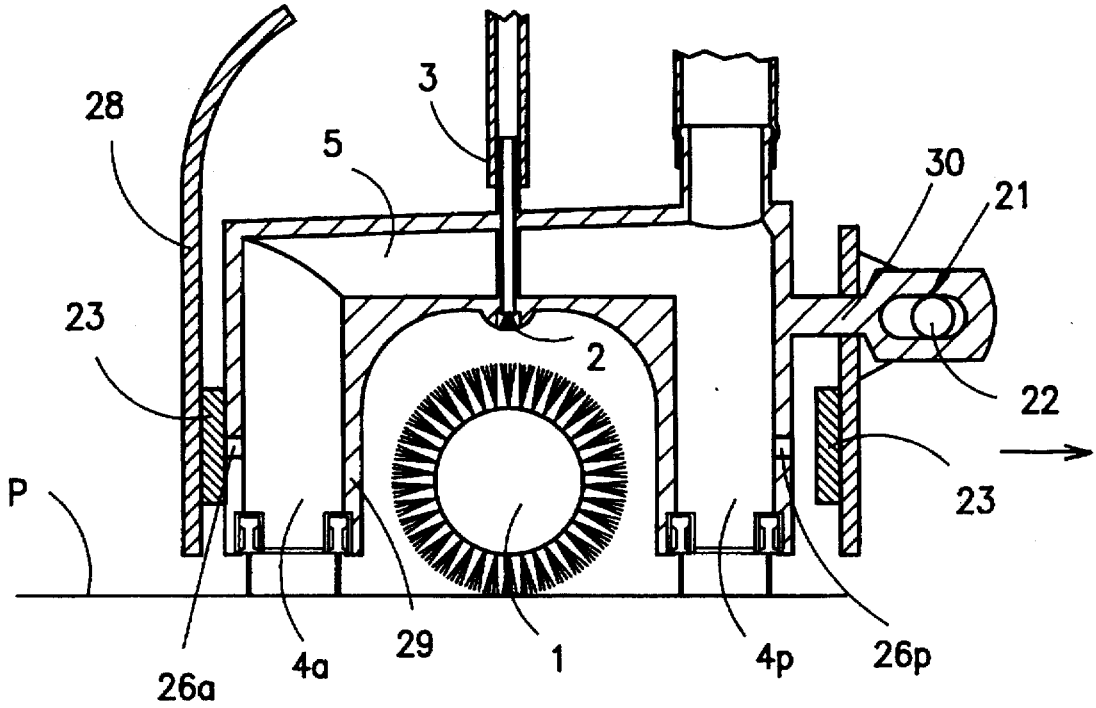
FIG. 4 is a view similar to FIG. 3 showing the movement of the members for controlling suction to the front and rear ducts of the floor-cleaning machine.

FIG. 4 represents the opposite situation, in which the floor-cleaning machine is pulled; the support (29) moves through friction towards the front part of the machine, that is, opposite to the motion of the machine; the hole (26*a*) of the front nozzle (4*a*), positioned behind the brush (1) with respect to the motion of the machine, rests on the elastic surface (23), while the rear nozzle (4*p*), positioned before the brush (1) with respect to the motion of the machine, is spaced from the elastic surface (23).

Figure 5:
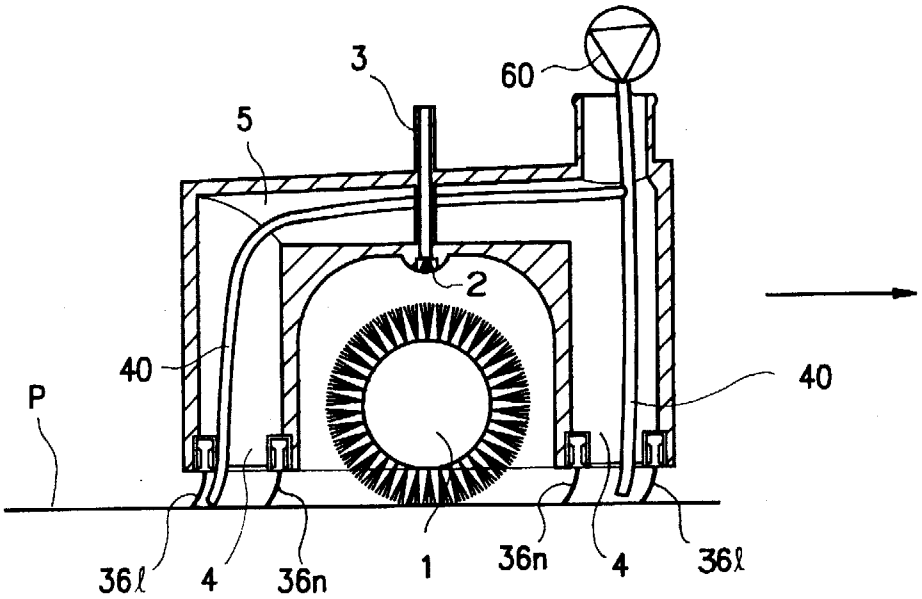
FIG. 5 is a partial, schematic side cross-sectional view showing another embodiment of the present invention in which additional suction conduits are provided extending through the ducts of the floor cleaning machine of the present invention.

FIG. 5 shows a partial schematic side view of the floor-cleaning machine. The cleaning brush (1) receives the cleansing liquid thorugh a sprayer (2) positioned over it. At the front and at the rear of the cleaning brush (1) there are two nozzles (4) for the suction of the dirty cleansing liquid; the two suction nozzles (4) are communicating through a piece of horizontal duct (5) passing above the cleaning brush (1) and around the cleansing liquid conveying duct (3).

Figure 6B:
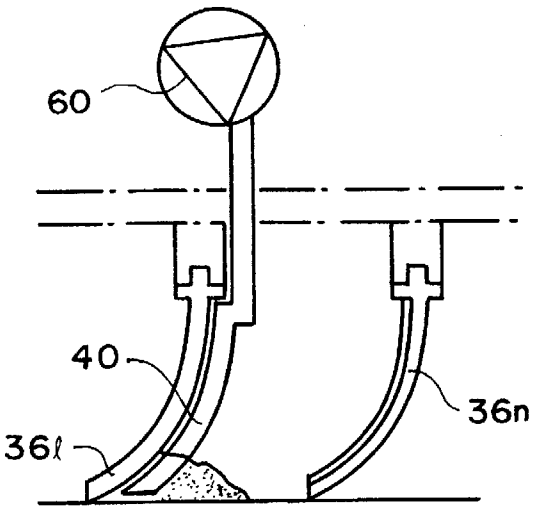
FIG. 6 is an enlarged partial cross-sectional view showing the additional suction conduits of FIG. 5.
Figure 6A:
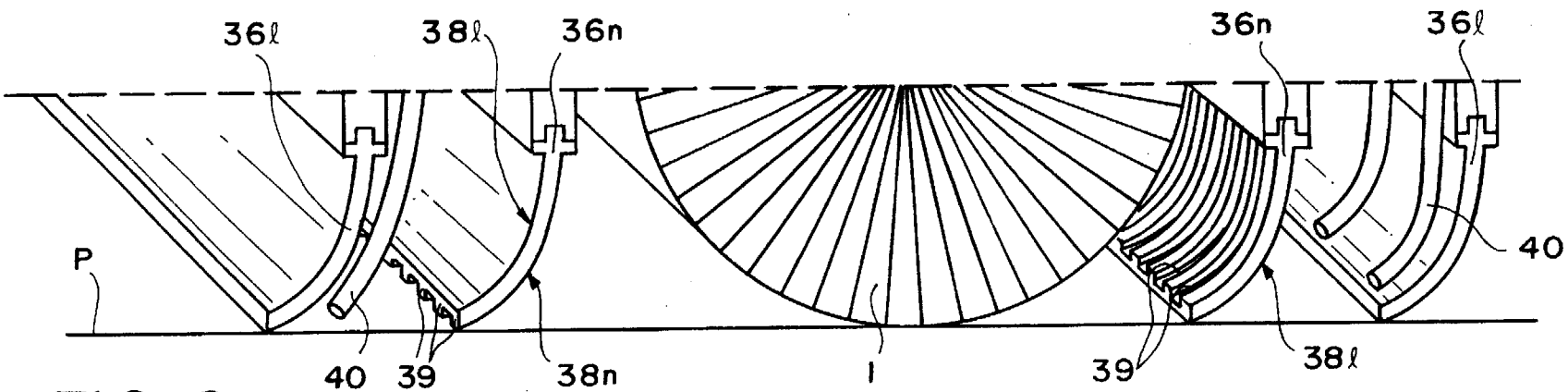

FIGS. 6 and 6*b* show a detailed view of the edges (36 l, 36 n) of the nozzles (4).

Each suction nozzle (4) is provided with two lower flexible edges (36) which adhere to the floor (P) and when the machine moves bend in the direction opposite to its motion. The surfaces of both the nozzle (4) edges (36 l) which are farthest from the brush (1) are smooth; the nozzle edges (36 n) which are nearest to the brush (1) have the surface (38 l) facing the inside of the nozzle (4) which is smooth, while the surface (38 n) facing the brush (1) is provided with ribs or protrusions (39).

During the use of the floor-cleaning machine the smooth edges (36 l) of the nozzles (4) adhere to the floor (P), thus preventing the outflow of the cleansing liquid; the ribbed edge (36 n) of the nozzle (4) which is positioned before the brush (1) adheres to the floor (P) with its smooth surface (38 l), thus preventing the cleansing liquid from spreading forwards; the ribbed edge (36 n) of the nozzle (4) which is positioned behind the brush (1) adheres to the floor (P) with its ribbed surface (38 n), thus allowing the cleansing liquid to spread inside the nozzle (4), by which it is sucked.

The additional suction ducts (40) are positioned inside each nozzle (4), so that its mouth is placed in correspondence with the smooth edge (36 l) and in correspondence with the floor (P), in such a way as to suck the cleansing liquid and the dirt from the area where they accumulate. An additional pump (60) sucks the dirty liquid through ancillary suctions ducts (40).

Figure 7:
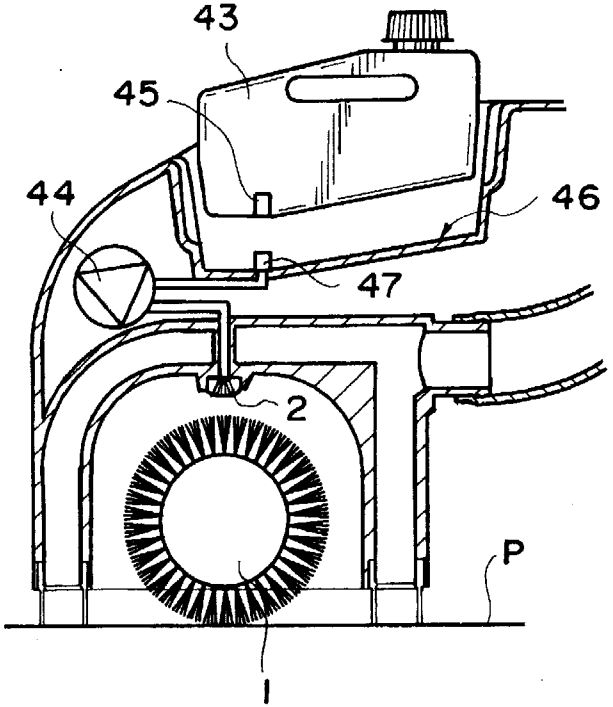
FIG. 7 is an enlarged partial perspective view of the flap seals utilized with the embodiment as shown in FIG. 5.

FIG. 7 shows a partial schematic side view of the floor-cleaning machine with separate tanks.

It is possible to observe the cleaning brush (1) which receives the cleansing liquid through a sprayer (2) positioned over it and connected with the cleansing liquid tank (43) by means of the relevant pump (4).

The tank (43) can be removed and is provided with a valve (45) in its lower part; the floor-cleaning machine is provided with a compartment (46) suitable for housing the tank (43), on the bottom of which there is a manifold (47) positioned in correspondence with the valve (45) of the tank (43).

Both the tank (43) and the compartment (46) are shaped so that the insertion of the tank (43) in the compartment (46) is facilitated.

Figure 8A:
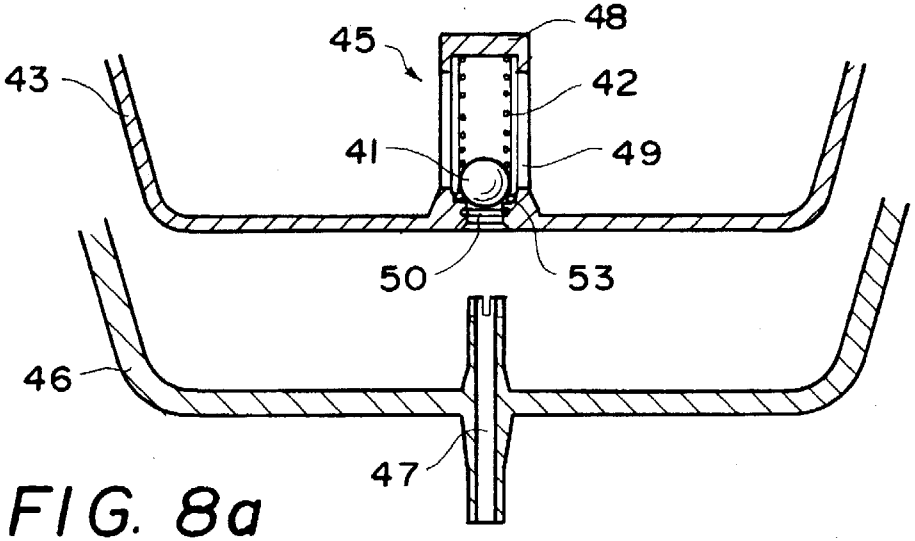
FIGS. 8*a* and 8*b* are views showing the opening of a valve for allowing fluid to be dispensed to the machine from the removable tank shown of FIG. 7.
Figure 8B:
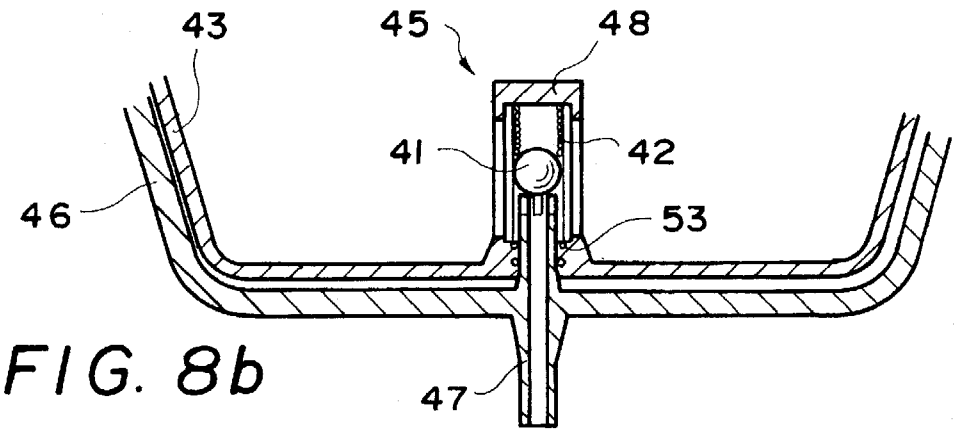

FIGS. 8*a* and 8*b* show both the manifold (47) and the valve (45) in detail, in the two moments before and after the insertion of the tank (43) in the compartment (46).

The manifold (47) consists of a vertical rigid pipe open in its upper part.

The valve (45) consists of a vertical cylinder (48) perforated both on its sides (49) and on its lower part (50). The cylinder (48) houses a ball (41), preferably made of metal, which is pushed downwards by a spring (42). Near the lower opening (50) there are one or more seals (53).

When the tank (43) is extracted from the machine (FIG. 8*a*) the ball (41) is pushed downwards by the spring (42) until it adheres to the lower seal (53), in such a way as to prevent the outflow of the cleansing liquid.

When the tank (43) is correctly positioned in the machine, the manifold (47) is inserted through the lower opening (50), thus lifting the ball (41) and allowing the cleansing liquid to flow through the upper opening of the manifold (47).

The above are the basic outlines of the invention, on the basis of which the technician will be able to provide for implementation; therefore, upon implementation certain variants may be present, without any negative effect upon the basic innovation.

With reference to the above description and the attached tables, the following claims are put forth.

I claim:

1. In a floor-cleaning machine having a brush, an inlet duct for introducing cleansing fluid, a supply valve means for controlled dispensing of said cleansing fluid, a sprayer for discharging the cleansing liquid relative to the brush, and dirty liquid suction ducts which are oriented on opposite sides of the brush and which are in open communication with a connecting duct which communicates with a suction outlet for dirty liquid, the improvement comprising:

an additional suction nozzle including a suction conduit having a by-pass connector manifold joined at one end of said conduit which is selectively insertable within the connecting duct, said connector manifold having an opening therein for communicating said suction conduit of said additional suction nozzle with the suction outlet, a pipe element extending from said connector manifold and insertable within the supply valve means so as to direct cleansing fluid therethrough when said connector manifold is inserted within the connecting duct, and a fluid cleansing duct connected to said pipe element and extending within said suction conduit of said additional suction nozzle, whereby upon insertion of said by-pass connector manifold within the connecting duct, suction is established through said suction conduit of said additional suction nozzle and said cleansing fluid is provided through said pipe element and said fluid cleansing duct.

2. In the floor-cleaning machine of claim 1, wherein said machine includes a coupling opening in the floor-cleaning machine communicating with the connecting duct and a sealing cover normally closing said coupling opening, said sealing cover being moveable to permit the insertion of said connector manifold within said coupling opening.

3. In the floor-cleaning machine of claim 1, the improvement further comprising the supply valve means including a housing having a first opening within the connecting duct which is normally closed by a first ball valve member and a second opening communicating with the sprayer, a second ball valve member mounted within said housing and being normally spaced from said second opening, said second ball valve member being moveable upon the insertion of said pipe element to close said second opening while said first ball valve member is moved from said first opening, thereby allowing fluid flow from said inlet duct to said cleansing fluid duct of said additional suction nozzle.

4. The improvement of claim 3 wherein said supply valve includes a first spring element for urging said first ball valve member toward said first opening and a second spring element for normally urging said second ball valve member away from said second opening to thereby communicate the inlet duct with the sprayer automatically upon the removal of said pipe element from said supply valve means.

* * * * *